United States Patent [19]

Masumoto et al.

[11] Patent Number: 4,468,370

[45] Date of Patent: Aug. 28, 1984

[54] ELECTRICAL RESISTANT ALLOYS HAVING A SMALL TEMPERATURE DEPENDENCE OF ELECTRICAL RESISTANCE OVER A WIDE TEMPERATURE RANGE AND A METHOD OF PRODUCING THE SAME

[75] Inventors: Hakaru Masumoto; Naoji Nakamura, both of Sendai, Japan

[73] Assignee: The Research Institute of Electric and Magnetic Alloys, Sendai, Japan

[21] Appl. No.: 397,226

[22] Filed: Jul. 12, 1982

Related U.S. Application Data

[62] Division of Ser. No. 151,712, May 20, 1980, Pat. No. 4,374,679.

[51] Int. Cl.[3] ..... C22C 5/00

[52] U.S. Cl. ..... 420/463

[58] Field of Search ..... 420/463–465

[56] References Cited

U.S. PATENT DOCUMENTS 3,788,833 1/1974 Short ..... 420/463

3,826,886 7/1974 Hara et al. ..... 200/266

FOREIGN PATENT DOCUMENTS 130437 10/1979 Japan ..... 420/463

*Primary Examiner*—M. J. Andrews

*Assistant Examiner*—Christopher W. Brody

*Attorney, Agent, or Firm*—Parkhurst & Oliff

[57] ABSTRACT

An electrical resistant alloy for use in a sensing coil having a small temperature dependence of electric resistance over a wide temperature range and a method of producing the same are disclosed. This alloy consists of 55.5 to 60.6 wt % of palladium and 44.5 to 39.4 wt % of silver and an inevitable amount of impurities, and has a temperature coefficient of electric resistance of $\pm 20\times 10^{-6}$/°C. over a temperature range of −50° C. to +730° C.

1 Claim, 4 Drawing Figures

ELECTRICAL RESISTANT ALLOYS HAVING A SMALL TEMPERATURE DEPENDENCE OF ELECTRICAL RESISTANCE OVER A WIDE TEMPERATURE RANGE AND A METHOD OF PRODUCING THE SAME

This is a division of application Ser. No. 151,712, filed May 20, 1980, now U.S. Pat. No. 4,374,679, issued July 22, 1983.

The present invention relates to an electrical resistant alloy consisting essentially of palladium and silver and containing an inevitable amount of impurities, which is suitable for use in a sensing coil of an eddy current displacement gauge (hereinafter referred to as a displacement gauge), and is to provide materials for the sensing coil having a relatively small specific resistance, a small temperature dependence of electric resistance over a wide temperature range, and an easiness of forging, drawing, rolling or winding.

The displacement gauge is employed to measure a change of inductance by installing it in a detecting part of an electric micrometer and utilizing an eddy current phenomenon generated therein, and can simply measure a microscopic distance, a displacement and shape of a rotator, a displacement and vibration number of a vibrator, a shape and position of an object, a gauge of a metal plate, an existence of flaws on the surface of the metal plate, a thickness of a coating or the like with a high sensitivity in a non-contact and non-destructive manner. Therefore, the displacement gauge is very effective for an instrumentation in quality or process control of productive factorys, an automatic control using together with a microcomputer and the like and the demand therefor is largely increased every year.

The principle of the displacement gauge will briefly be described with reference to FIG. 1, wherein numeral 1 is a bridge circuit, numeral 2 a detection circuit, numeral 3 a linearizing amplifier, numeral 4 a high frequency oscillator, numeral 5 an automatic gain controller, numeral 6 a sensing coil and numeral 7 a material to be measured. At first, a magnetic field H is generated in the sensing coil 6 by supplying an electric current I of few K to few MHz from the high frequency oscillator 4 to the sensing coil 6. As a result, an eddy current I' is produced on the surface of the measuring material 7 such as a metal plate (electrical conductor) and the like, which being separated only at a distance of d from the sensing coil 6, whereby a magnetic field H' opposite to the magnetic field H is generated to reduce the effective inductance of the sensing coil 6. Consequently, there are changed the amplitude and phase of the electric current passing through the sensing coil 6. Therefore, such displacement amounts are measured by using the electric circuits 1-3, whereby a gap or distance between the sensing coil 6 and the measuring material 7 can be determined.

Accordingly, electrical properties, use circumstance and stability of the sensing coil material to be used in the displacement gauge become considerably important. Heretofore, there have usually been used copper wires up to a maximum use temperature of 120° C. and silver wires up to a maximum use temperature of 400° C. as the sensing coil material, but these wires are very large in the temperature dependence of electric resistance, which is a cause of measurement error (0.15%/°C. in a full scale) due to the temperature change of the displacement gauge, so that accurate measurement of thrust displacement and the like cannot be performed. As the displacement gauge improving the above drawbacks, there is lately a commercially available one using a manganin wire composed of a copper-manganese alloy, which is a precision resistant material. This alloy is poor in the sharpness of quality factor due to a relatively large specific resistance (about 47 μΩcm), but has a very small temperature coefficient of electric resistance near room temperature, so that it is used in all most of sensing coils at present. However, the above alloy has a great drawback that a different output is indicated every the temperature rising because the temperature hysteresis of the properties is very large due to the precipitation of α-Mn phase or the formation of superlattices as shown in FIG. 2 and there are such many problems that the change of time lapse is large and unstable, the reliability as a high-temperature type sensing coil material is poor, corrosion resistance and antioxidation property are considerably poor and the like, so that the alloy is useless in use under high temperature conditions.

As the sensing coil material, there is considered a copper-nickel alloy having a small temperature dependence of electric resistance over a wide temperature range in addition to the manganin. However, this alloy is very large in the specific resistance (about 50 μΩcm) and poor in the corrosion resistance and antioxidation property, so that it is not used in low-or high-temperature type sensing coil at all.

Recently, it is strongly demanded to develop high-temperature type sensing coil materials requiring a high stability in order to rapidly and accurately ensure the measurement of plate gauge, confirmation of flaws and foreign matter, and examination of surface smoothness in the continuous casting and hot rolling processes, vibration state and accidents of engine casing and injection nozzle in rockets for artificial satellite, or the like.

The inventors have made various investigations on the high-temperature type sensing coil material and found out that palladium-silver alloys containing 39.4 to 44.5 wt%, preferably 40.1 to 43.9 wt% of silver have a very small temperature dependence of electric resistance at an elevated temperature, are very stable at the elevated temperature owing to the homogeneous solid solution and less in the change of lapse time, and have excellent corrosion resistance and antioxidation property in air even at an elevated temperature of 1,000° C., a small specific resistance as compared with the manganin wire, and an excellent workability.

Namely, the present invention provides an electrical resistant alloy consisting of 55.5 to 60.6 wt% of palladium and 44.5 to 39.4 wt% of silver and containing an inevitable amount of impurities and having a temperature coefficient of electric resistance of not more than $\pm 20\times 10^{-6}$/°C. over a temperature range of −50° C. to +730° C., preferably an electrical resistant alloy consisting of 56.1 to 59.9 wt% of palladium and 43.9 to 40.1 wt% of silver and containing an inevitable amount of impurities and having a temperature coefficient of electric resistance of not more than $\pm 10\times 10^{-6}$/°C. over a temperature range of −50° C. to +600° C., which has a relatively small specific resistance (about 43 μΩcm at maximum) and a Vickers hardness of not more than 100 and is very soft and easy in the forging, drawing, rolling and winding, and a method of producing such alloy and a sensing coil manufactured from the same. The alloy of the present invention is suitable as an electrical resistant material for use in standard resistors, precision measuring instruments and the like in addition to the sensing coils.

In order to make the alloy of the present invention, a proper amount of a starting material consisting of 55.5 to 60.6 wt% of palladium and 44.5 to 39.4 wt% of silver is firstly melted by a suitable melting furnace in air, preferably in a non-oxidizing atmosphere or in vacuo and thoroughly stirred to obtain a molten alloy having a homogeneous composition. Then, the thus obtained alloy is poured into a mold having adequate shape and size to form a sound ingot, which is further subjected to a forging or various workings at room temperature to make an article of a suitable shape, for instance, a rod or a plate. This article is used as it is, or is heated at a recrystallization temperature of about 500°-1,100° C. for a time of not less than 2 seconds to not more than 100 hours and then annealed. Next, the annealed article is subjected to a cold working by swaging, drawing or squeezing to make an article of a desired shape, for instance, a fine wire or a thin sheet. Further, the cold-worked article is heated at a recrystallization temperature of about 500°-1,100° C. in air, preferably in a non-oxidizing atmosphere or in vacuo at least for more than 2 seconds and less than 100 hours to conduct the homogenization and stabilization and, if necessary, subjected to a slow cooling to remove an internal stress, whereby an electrical resistant alloy having excellent properties is obtained. The thus obtained alloy is very soft, so that the winding of coil shape is easy, but it is required to have an electrically insulating property in order to meet the miniaturization of high-temperature type sensing coil. For this purpose, an inorganic insulating body or an insulative coating composed of silica, alumina, magnesia, fluoride, boride or the like is formed on the surface of the alloy by a suitable procedure of electrodeposition, vapor deposition, sputtering and the like. If necessary, the internal stress of the alloy may be again removed by the above mentioned heat treatment, whereby there can be produced excellent high-temperature type sensing coils having the same properties as in the electrical resistant alloy itself.

The present invention will now be described in detail with reference to the accompanying drawings, wherein.

Figure 3:
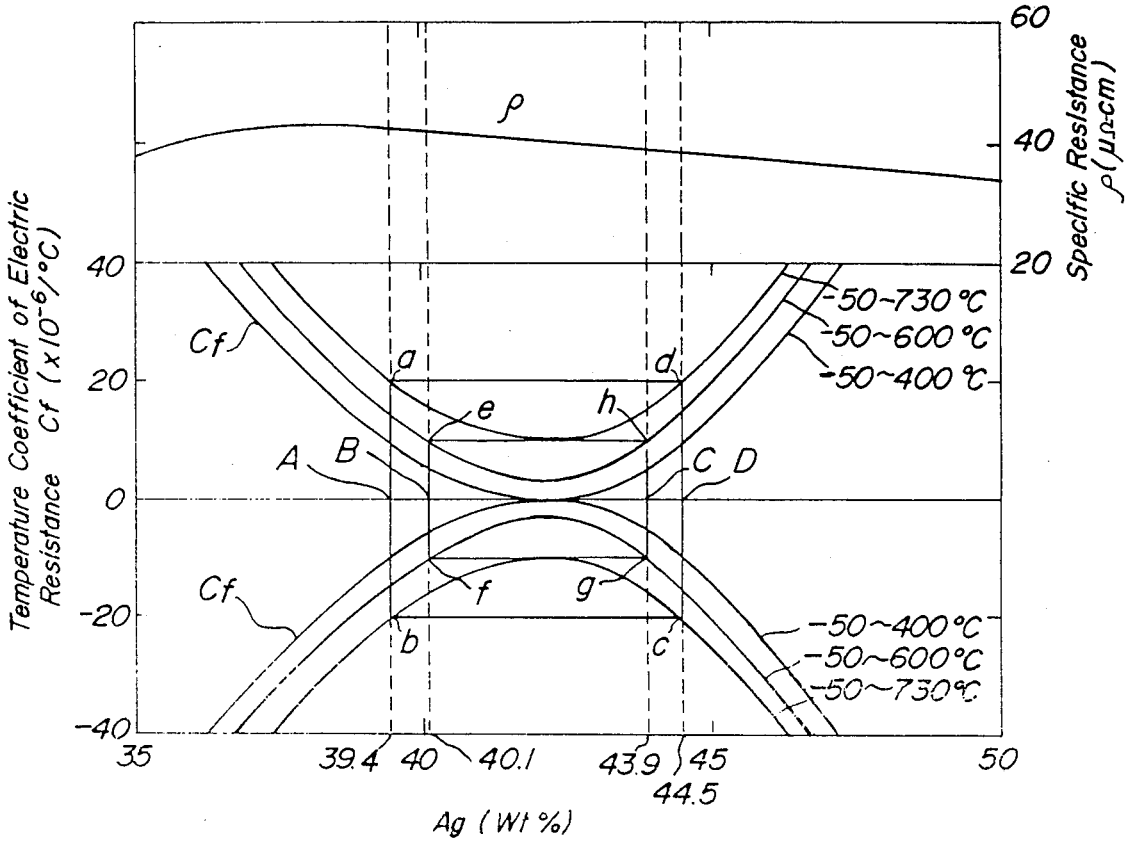
Figure 4:
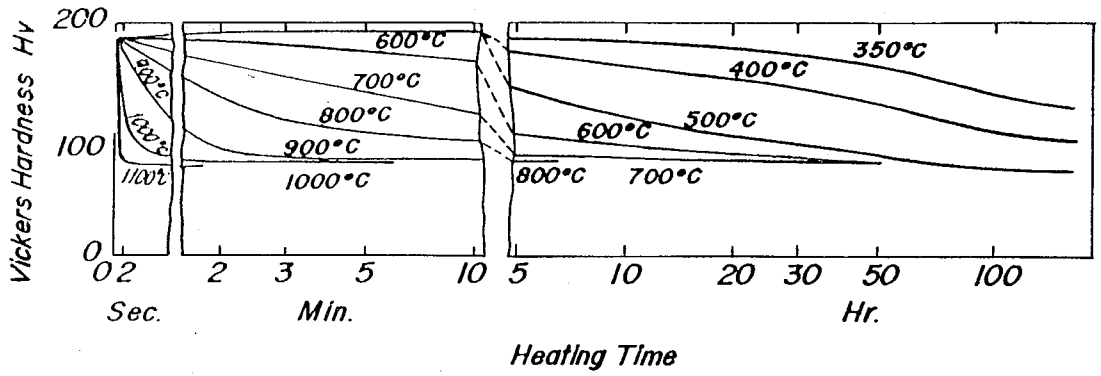

FIG. 3 is a graph showing an average temperature coefficient of electric resistance over temperature ranges of −50° C. to +400° C., −50° C. to +600° C. and −50° C. to +730° C., and a specific resistance at room temperature to the silver content in palladium-35 to 50% silver alloys; and FIG. 4 is a graph showing a change of Vickers hardness to the heating time when heating the alloy specimen A to various temperatures.

The following examples are given illustration of the present invention and are not intended as limitations thereof.

EXAMPLE 1

Alloy specimen A consisting of 57% of palladium and 43% of silver

As a starting material, palladium having a purity of not less than 99.9% and silver having a purity of not less than 99.95% were used. The starting materials were charged in a total amount of 1 kg into a high-purity alumina crucible and melted in a high frequency induction electric furnace, while blowing an argon gas onto a surface of a melt to prevent oxidation, and then thoroughly stirred to obtain a homogeneous molten alloy. Next, the thus obtained melt was poured into an iron mold of 30 mm square. The resulting ingot was polished at its outer surface by means of a milling machine. The thus obtained rectangular material was subjected to a homogenizing treatment at an elevated temperature and then forged and hot rolled to form a round bar of 10 mm diameter. This round bar was shaped into a fine wire of 0.23 mm diameter by swaging and cold drawing while repeating an annealing treatment several times, from which was cut out a specimen used for the measurement of electric resistance and hardness at a proper length. The measurement of electric resistance was performed over a temperature range of −150° C. to +800° C. The heat treating condition and properties of the specimen are shown in the following Table 1 and FIG. 2.

TABLE 1

| Heat treatment | Temperature range showing a temperature coefficient of electric resistance of $\pm 10 \times 10^{-6}$/°C. (°C.) | Temperature range showing a temperature coefficient of electric resistance of $\pm 20 \times 10^{-6}$/°C. (°C.) | Specific resistance at room temperature $\rho$ ($\mu\Omega \cdot$ cm) | Vickers hardness Hv |
|---|---|---|---|---|
| After cold drawing, heated at 500° C. in vacuo for 50 hours and cooled in furnace up to room temperature | 100~380 | −180~700 | 39.4 | 87 |
| After cold drawing, heated at 700° C. in vacuo for 5 hours and cooled in furnace up to room temperature | −50~600 | −50~650 | 39.3 | 87 |
| After cold drawing, heated at 900° C. in vacuo for 1 hours and cooled in furnace up to room temperature | −50~600 | −50~730 | 39.3 | 85 |

In Table 1, the temperature range shows lower and upper limits of a resistance-temperature curve when the temperature coefficient of electric resistance ranges from $-10\times10^{-6}$/°C. to $+10\times10^{-6}$/°C. or from $-20\times10^{-6}$/°C. to $+20\times10^{-6}$/°C.

EXAMPLE 2

Alloy specimen B consisting of 62% of palladium and 38% of silver

As a starting material, palladium and silver each having the same purity as described in Example 1 were used. The starting materials were charged in a total amount of 5 g into a high-purity alumina crucible and melted in a Tammann furnace in air, while blowing an argon gas onto a surface of a melt to prevent oxidation, and then thoroughly stirred to obtain a homogeneous molten alloy. Next, this molten alloy was sucked up into a quartz tube having an inner diameter of 2.6–2.7 mm, subjected to a vacuum annealing at a temperature of 1,000° C. to conduct homogenization and then shaped into a fine wire of 0.5 mm diameter by swaging and cold drawing. A speciment was cut out from the wire at a proper length. The heat treating condition and properties of the specimen are shown in the following Table 2 and FIG. 2.

TABLE 2

| Heat treatment | Temperature range showing a temperature coefficient of electric resistance of $\pm 10 \times 10^{-6}$/°C. (°C.) | Temperature range showing a temperature coefficient of electric resistance of $\pm 20 \times 10^{-6}$/°C. (°C.) | Specific resistance at room temperature $\rho$ ($\mu\Omega \cdot$ cm) | Vickers hardness Hv |
|---|---|---|---|---|
| After cold drawing, heated at 500° C. in vacuo for 50 hours and cooled in furnace up to room temperature | 90~400 | 50~500 | 43.1 | 98 |
| After cold drawing, heated at 700° C. in vacuo for 5 hours and cooled in furnace up to room temperature | 100~440 | 50~500 | 43.1 | 99 |
| After cold drawing, heated at 900° C. in vacuo for 1 hours and cooled in furnace up to room temperature | 100~450 | 30~550 | 43.0 | 95 |

EXAMPLE 3

Alloy specimen C consisting of 55% of palladium and 45% of silver

The same starting materials as in Example 2 were used. A specimen was prepared in the same manner as described in Example 2. The heat treating condition and properties of the thus obtained specimen are shown in the following Table 3 and FIG. 2.

TABLE 3

| Heat treatment | Temperature range showing a temperature coefficient of electric resistance of $\pm 10 \times 10^{-6}$/°C. (°C.) | Temperature range showing a temperature coefficient of electric resistance of $\pm 20 \times 10^{-6}$/°C. (°C.) | Specific resistance at room temperature $\rho$ ($\mu\Omega \cdot$ cm) | Vickers hardness Hv |
|---|---|---|---|---|
| After cold drawing, heated at 500° C. in vacuo for 50 hours and cooled in furnace up to room temperature | 120~400 | 80~550 | 37.9 | 95 |
| After cold drawing, heated at 700° C. in vacuo for 5 hours and cooled in furnace up to room temperature | 100~400 | 80~540 | 37.8 | 93 |
| After cold drawing, heated at 900° C. in vacuo for 1 hours and cooled in furnace up to room temperature | 100~420 | 70~560 | 37.9 | 91 |

Figure 1:
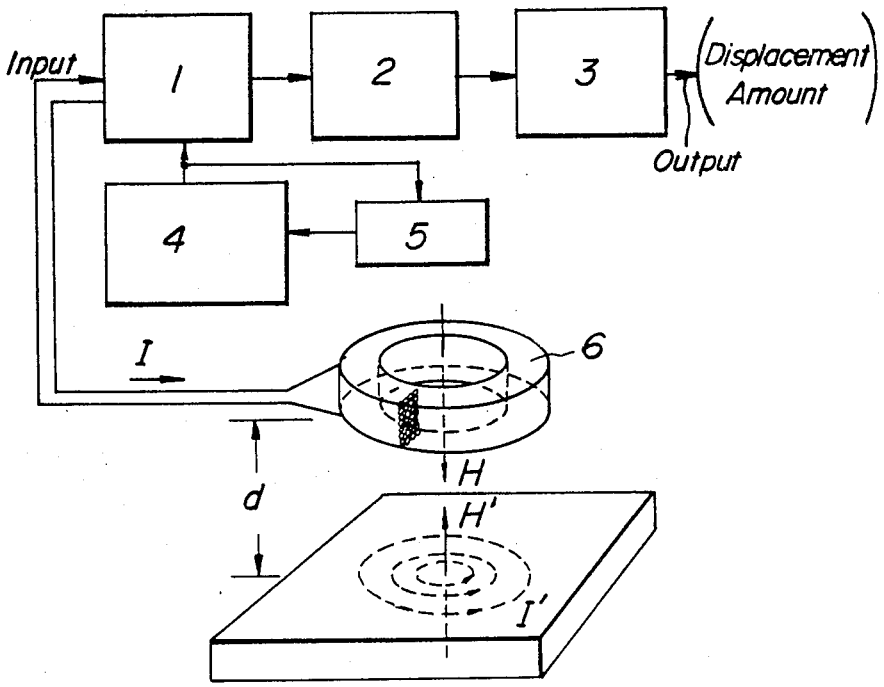
FIG. 1 is a schematic view illustrating the principle of the eddy current displacement gauge as mentioned above.
Figure 2:
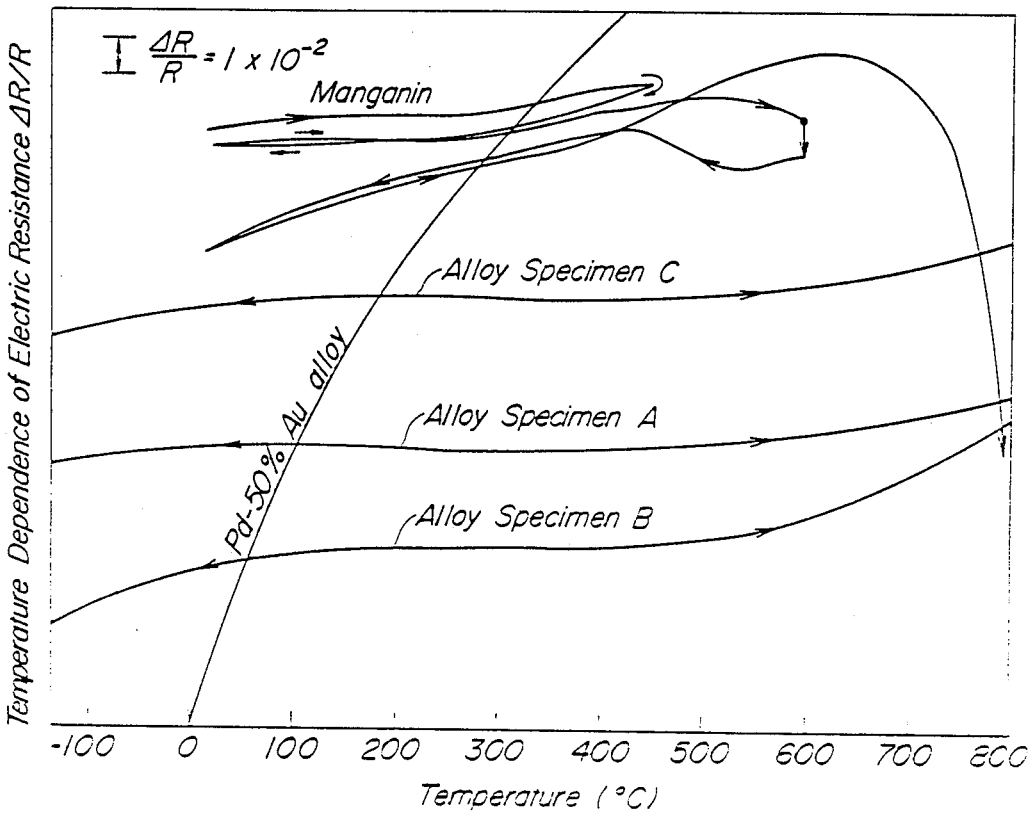
FIG. 2 is a graph showing a temperature dependence of electric resistance in alloy specimens A–C according to the present invention after heated at 900° C. in vacuo for 1 hour and cooled in furnace and the known manganin after heated at 600° C. in vacuo for 1 hour and cooled in furnace, also showing the temperature dependence of electrical resistance for PD-50% Au alloy.

As shown in Tables 1–3 and FIG. 2, all of the alloys of Examples 1–3 are very small in the temperature dependence of electric resistance. Particularly, it is understood that the alloy specimen A has a very small temperature dependence of electric resistance over a wide temperature range of −50° C. to +730° C., and the higher the heat treating temperature, the wider the temperature range showing a small temperature coefficient of electric resistance and also the lower the hardness. Furthermore, the value of specific resistance in these alloys is smaller than that of the known manganin. FIG. 2 also shows the high temperature dependence of electrical resistance for Pd-50% Au alloy. Thus, these alloys have a small temperature coefficient of not more than $\pm 20 \times 10^{-6}$/°C. over a wide temperature range of −50° C. to +730° C., a small specific resistance and a low hardness, which have never been achieved in the conventional alloy, so that it can be said that they fully satisfy the properties required for use in a high-temperature type sensing coil.

In FIG. 3 are shown an average temperature coefficient $C_f(=\Delta R/R \cdot \Delta T)$ of electric resistance over temperature ranges of −50° C. to +400° C., −50° C. to +600° C. and −50° C. to +730° C., and a specific resistance p at room temperature in palladium-silver alloys having various silver contents. This measurement was performed after the wire material obtained by the cold working of the alloy was heated at 900° C. in vacuo for 1 hour and then cooled in furnace. As apparent from FIG. 3, the average temperature coefficient $C_f$ of $+20 \times 10^{-6}$/°C. is obtained in a range of silver content of from 39.4% to 44.5% (a range of point A to point D), and also the $C_f$ of $\pm 10 \times 10^{-6}$/°C. is obtained in a range of silver content of from 40.1% to 43.9% (a range of point B to point C).

In FIG. 4 is shown a Vickers hardness Hv to the heating time when the alloy specimen A of Example 1 is heated at various temperatures. As apparent from FIG. 4, the higher the heating temperature, the shorter the heating time required for obtaining a Vickers hardness of not more than 100. That is, when the heating temperature is 350° C., the Vickers hardness Hv does not reach to 100 even after 100 hours, while when the heating temperature becomes higher than 500° C., the heating time requiring for obtaining the Hv of not more than 100 becomes more shorter. Moreover, the change of the Vickers hardness Hv in the alloy specimens B and C exhibits a tendency similar to that of FIG. 4. In any case, the Vickers hardness Hv of not more than 100 is found to be obtained under such heat treating conditions that the heating temperature is above 500° C. and the heating time is less than 100 hours.

In the present invention, the reason why the silver content of palladium-silver alloys is limited to a range of 39.4 to 44.5 wt% is due to the fact that the temperature coefficient of electric resistance over a temperature range of −50° C. to +730° C. is not more than $\pm 20\times 10^{-6}$/°C. within the above defined range of the silver content, but when the silver content deviates from the above range, the value of the temperature coefficient becomes large so as to be improper to use as an alloy having a small temperature dependence of electric resistance over a wide temperature range as understood from each Example and FIGS. 2 and 3.

In the production of the alloy according to the present invention, the reason why the heating temperature is limited to a range of 500° to 1,100° C. is due to the fact that the temperature coefficient of electric resistance over a temperature range of −50° C. to +730° C. is not more than $\pm 20\times 10^{-6}$/°C. and at the same time the Vickers hardness is not more than 100 within the above defined range as understood from each Example and FIG. 4. When the heating temperature is less than 500° C., the Vickers hardness exceeds 100 and hence the winding operation becomes difficult, while when the heating temperature is more than 1,100° C., silver is liberated from the alloy material by volatilization and reacts with or adheres to a support or an insulative substance for the alloy material, whereby the electrically insulating property is damaged or the welding between the alloy materials is caused.

Moreover, the reason why the heating time is limited to a range of 2 seconds to 100 hours when the alloy is heated at a temperature of the above defined range is due to the fact that the Vickers hardness reduces to not more than 100 and the internal stress can sufficiently be removed within the above defined range of the heating time as understood from each Example and FIG. 4. When the heating time is outside the above range, the Vickers hardness exceeds 100 and hence the winding operation becomes difficult. Therefore, the heating time should properly be selected in accordance with the heating temperature.

In brief, the alloys of the present invention have a very small temperature dependence of electric resistance over a wide temperature range of −50° C. to +730° C. and a good stability, are small in the hardness and soft and hence have a good workability and an easiness of the winding and further have excellent corrosion resistance and antioxidation property at an elevated temperature, so that they are suitable as an electrical resistant material for not only sensing coils but also standard resistors, precision measuring instruments and the like.

In the alloy of the present invention, palladium and silver each having a relatively high purity are used as mentioned in each Example. However, even if the alloy contains an inevitable amount of impurities or not more than 2 wt% of at least one element selected from copper, gold and the like or not more than 1 wt% of at least one element selected from nickel, platinum, rhodium, iridium and the like, when sufficiently controlling the homogenization treatment and its atmosphere, the properties of the resulting alloy are not affected seriously.

What is claimed is:

1. An electrical resistant alloy consisting essentially of 56.1 to 59.9 wt% of palladium and 43.9 to 40.1 wt% of silver, and having a temperature coefficient of electric resistance of $+10\times 10^{-6}$/°C. over a temperature range of −50° C. to 600° C.

* * * * *